US008238588B2

(12) United States Patent
Meyer et al.

(10) Patent No.: US 8,238,588 B2
(45) Date of Patent: Aug. 7, 2012

(54) LOUDSPEAKER SYSTEM AND METHOD FOR PRODUCING SYNTHESIZED DIRECTIONAL SOUND BEAM

(75) Inventors: John D. Meyer, Berkeley, CA (US); Perrin Meyer, Albany, CA (US); Roger Schwenke, Albany, NY (US); Alejandro Antonio Garcia Rubio, Richmond, CA (US); Paul Joseph Kohut, Berkeley, CA (US); Richard D. Herr, Berkeley, CA (US); Jon M. Arneson, Napa, CA (US); Peter C. Soper, Berkeley, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 657 days.

(21) Appl. No.: 12/361,517

(22) Filed: Jan. 28, 2009

(65) Prior Publication Data

US 2009/0238383 A1 Sep. 24, 2009

Related U.S. Application Data

(63) Continuation-in-part of application No. 11/641,549, filed on Dec. 18, 2006, now abandoned.

(60) Provisional application No. 61/062,945, filed on Jan. 29, 2008.

(51) Int. Cl.
*H04R 1/02* (2006.01)

(52) U.S. Cl. ..... 381/182; 381/332; 381/386

(58) Field of Classification Search ..... 381/82, 381/87, 182, 332, 386
See application file for complete search history.

(56) References Cited

U.S. PATENT DOCUMENTS

| | | | | |
|---|---|---|---|---|
| 4,524,372 | A | 6/1985 | De Cock et al. | |
| 4,550,229 | A | 10/1985 | Hwang | |
| 5,309,518 | A | 5/1994 | Ickler et al. | |
| 5,781,645 | A | 7/1998 | Beale | |
| 5,821,470 | A | 10/1998 | Meyer et al. | |
| 6,262,946 | B1 * | 7/2001 | Khuri-Yakub et al. | 367/181 |
| 6,628,796 | B2 | 9/2003 | Adamson | |
| 6,959,096 | B2 | 10/2005 | Boone et al. | |
| 7,206,427 | B2 | 4/2007 | Simidian, II et al. | |
| 7,299,893 | B2 | 11/2007 | Meyer et al. | |
| 7,336,793 | B2 | 2/2008 | Horbach et al. | |
| 2002/0131608 | A1 * | 9/2002 | Lobb et al. | 381/111 |
| 2005/0057284 | A1 * | 3/2005 | Wodnicki | 327/100 |
| 2005/0180577 | A1 | 8/2005 | Horbach | |
| 2005/0201583 | A1 * | 9/2005 | Colich | 381/335 |
| 2006/0098830 | A1 | 5/2006 | Roeder et al. | |

(Continued)

FOREIGN PATENT DOCUMENTS

| | | | |
|---|---|---|---|
| JP | 06038289 | A * | 2/1994 |
| WO | WO 2004075601 | A1 * | 9/2004 |
| WO | WO/2009/097462 | | 8/2009 |

*Primary Examiner* — Tom Thomas
*Assistant Examiner* — Christopher M Roland
(74) *Attorney, Agent, or Firm* — Beeson Skinner Beverly

(57) ABSTRACT

A loudspeaker system has a plurality of relatively small transducer elements configured in a closely spaced transducer array such that their acoustic outputs combine to produce a focused beam of sound in front of the array that is substantially uniform about the beams radiation axis. The transducer array lies in a plane and has a perimeter that approximates a circle, and will have fill-factor with respect to a circle circumscribing the array of at least approximately 70%. In one variation of the loudspeaker system, the transducer array is constructed in smaller transducer array modules that are operatively fitted together to produce a larger array.

11 Claims, 15 Drawing Sheets

U.S. PATENT DOCUMENTS

2006/0159286 A1 7/2006 Stiles et al.
2006/0204022 A1 9/2006 Hooley et al.
2007/0201711 A1 8/2007 Meyer et al.
2008/0290757 A1* 11/2008 Gao et al. ..... 310/322

* cited by examiner

LOUDSPEAKER SYSTEM AND METHOD FOR PRODUCING SYNTHESIZED DIRECTIONAL SOUND BEAM

CROSS-REFERENCE TO RELATED APPLICATIONS

This application claims the benefit of U.S. provisional patent application No. 61/062,945, filed Jan. 29, 2008, and is a continuation-in-part of U.S. patent application Ser. No. 11/641,549 filed Dec. 18, 2006, now abandoned.

BACKGROUND OF THE INVENTION

The present invention generally relates to loudspeakers used for sound reinforcement, and more particularly relates to loudspeakers capable of focusing a large amount of acoustic energy into a relatively narrow beam of intelligible sound that can be propagated over long distances.

Long throw acoustical transmitting systems have been devised using parabolic dishes to focus the acoustic energy produced by a driving transducer positioned at the focal point of the parabolic dish. One such loudspeaker system is described in U.S. Pat. No. 5,821,470. This patent describes a system in which a parabolic dish reflects acoustic power produced by a high frequency horn loaded driver, and in which a low frequency driver is embedded in the center of the dish for extending the low end of the system's frequency range. Parabolic dish systems such as disclosed in U.S. Pat. No. 5,821,470 are capable of producing a relatively narrow beam of high acoustic power for long throw applications. However, they have a number of disadvantages.

First, the parabolic dishes and the mechanical structures required to support a driver at the dishes focal point create a relatively large and bulky apparatus. Consequently, this type of system is not well suited to applications where space is limited. Also, the dish's beam width, at any single frequency or range of frequencies, is essentially a function of the physical geometry (shape and size of parabolic reflector, and distance and shape of horn and transducer suspended in front of reflector, which generates the sound). Therefore once the geometry is selected for a given design it is not possible to alter the beam width. Not only is the beam width fixed with a parabolic reflector design, the axis of the beam remains perpendicular to the center of the parabolic reflector so redirecting the beam can only be accomplished by physically moving the parabolic dish.

Parabolic dish systems have yet other drawbacks. Obtaining a constant beam width over a wide range of frequencies with a parabolic dish is usually not possible. Lower frequencies will have wider beam widths than higher frequencies. Still further, the transducer and horn assembly suspended in front of the parabolic dish presents some interference with the sound reflected off the dish, both as an object in the path of sound and as a reflective surface back to the dish potentially causing echoes, so the transducer and horn must be kept relatively small, limiting the amount of power that can be generated by the transducer. Finally, if very high sound pressure level is desired from the dish, the compression and rarefaction becomes so great in the throat of the horn that distortion results as a vacuum is produced (194 dB SPL will normally produce a vacuum).

Other design approaches to achieve a narrow beam of acoustic energy over a wide range of frequencies for long throw applications, such as large horns or waveguides or multiple horns and transducers, also suffer from most of the limitations noted above and are similarly large and impractical to alter or redirect once set up.

The present invention overcomes the drawbacks and limitations of existing acoustic long throw systems (parabolic dish, and other horn and transducer cabinet arrangements) by providing an improved loudspeaker system that is relatively compact and that is capable of producing a high power beam of acoustic energy without the constraints imposed by conventional acoustic focusing structures such as parabolic dishes and horns, and that can be designed for fixed beam systems or systems that produce beams that can be electronically steered or altered without physically moving the loudspeaker or changing its physical features. The long throw loudspeaker system of the invention also is capable of producing a beam of acoustic energy where the beam width is relatively constant over the operating frequency range of the system.

SUMMARY OF THE INVENTION

The present invention is directed to a loudspeaker system having a plurality of contiguous transducer elements configured in a closely spaced transducer array such that their acoustic outputs combine to produce a focused beam of sound in front of the array that is substantially uniform about its axis of radiation, that contains high acoustic power, and that maintains its beam form over the operating frequency range the loudspeaker system. The transducer array lies in a plane and has a perimeter that approximates a circle. The transducers of the array will substantially fill a circle that is tangent to the outmost transducers of the array. It is contemplated that, to achieve a desired beam form the fill-factor for the circle circumscribing the array should be at least approximately 70%. The size of the transducer array is scalable by increasing the number of transducers in the array. Enlarging the array will extend the lower minimum operating frequency of the loudspeaker system while maintaining control over beam width.

The transducer elements of the closely packed, approximately circular transducer array are powered by one or more amplifiers, which receive an audio signal from one or more audio signal processors. The signal processors can be designed to create a controlled uniform beam width over an operating frequency range of the loudspeaker system, and can be implemented through either digital or analog circuitry. (The signal processor(s) can preferably also be used protect the transducers from damage due to over-excursion or overheating.) One or more audio inputs can be provided to the signal processors to accommodate different uses.

The loudspeaker system and method of the invention can provide a substantially uniform and focused beam of sound having a fixed polar pattern or a polar pattern that can be adjusted electronically by means of electronic signal processing. In the version with an adjustable polar pattern, the beam direction and/or beam shape can be electronically altered without the need to physically move loudspeaker or alter the loudspeaker's transducer elements or array. In the fixed beam version of the loudspeaker system only one signal processor is required to achieve a narrow beam width over a wide range of frequencies. Also, only one amplifier channel is required to power all the transducer elements, although several amplifiers can be used operating in a parallel to distribute the load of the transducer elements. Where electronic adjustability of the sound beam is desired, more than one, and most suitably several, signal processors and amplifiers are provided for separately powering the transducer elements or groups of transducer element in the transducer array. Such multi-channel signal processing would provide the capability of electronically altering the sound field in front of the transducer array, but would have the disadvantage of increasing the complexity of the system.

In either configuration of the invention (fixed or alterable sound field) side lobes of sound can be substantially attenuated or eliminated. This is a particular advantage in high power applications where people may be located close to the side of the loudspeaker. At very high sound pressure levels (SPL), side lobes could interfere with the operators of the loudspeaker.

As indicated above, the loudspeaker system of the invention can be made to accommodate multiple audio inputs. Any number of inputs can be configured to allow users to adjust the sound field through external audio sources. One particular mode of this multi-input configuration is where an audio input is available for each transducer. This can be used to recreate three dimensional sound images recorded in one location and space, using a microphone array dimensioned the same as the transducer array, and then played back in another space. Three dimensional sounds can also be synthesized with the invention by means of individual signal processing for each transducer and fewer audio inputs.

In a preferred embodiment the loudspeaker system of the invention, the approximately circular array of closely spaced, relatively small transducers are mounted onto a surface such as a heat conductive base plate. Typically the surface is flat for ease of design and manufacture, but does not need to be flat to implement the invention. Non-flat surfaces, for example a curved plane, will produce different beam widths than a flat surface, which could be used to an advantage provided sufficient experimentation or modeling is used to predict and optimize the shape. A flat surface simplifies the design and required measurement, experimentation, and modeling to achieving a desired beam width at different frequencies and also allows the transducer element array to be scaled in size.

In a further and alternative aspect of the invention, the transducer element array of the loudspeaker system is constructed in relatively small transducer array modules that can be readily and operatively fitted together to produce larger arrays having a circular fill factor greater than approximately 70%. Use of smaller modules also advantageously allows the transducers to be grouped within the larger array and power to readily be provided to the different groups of transducers.

In still a further and alternative aspect of the invention, the transducer elements of the transducer array are mounted to a rigid, heat conducting base plate structure which provides a heat sink for dissipating the heat generated by the transducer elements through the back of the transducer array.

The maximum level of sound pressure that can be generated from a transducer element array in accordance with the invention exceeds that of conventional loudspeaker systems of similar size and operating frequency range. High sound pressure levels can be accomplished using simple one to two inch dome tweeters, whereas conventional loudspeaker systems would require more specialized transducers to generate a similar SPL. A loudspeaker system with a transducer element array as described herein is capable of generating over 160 dB SPL peak at a one meter distance.

DETAILED DESCRIPTION OF THE ILLUSTRATED EMBODIMENT

Figure 1:
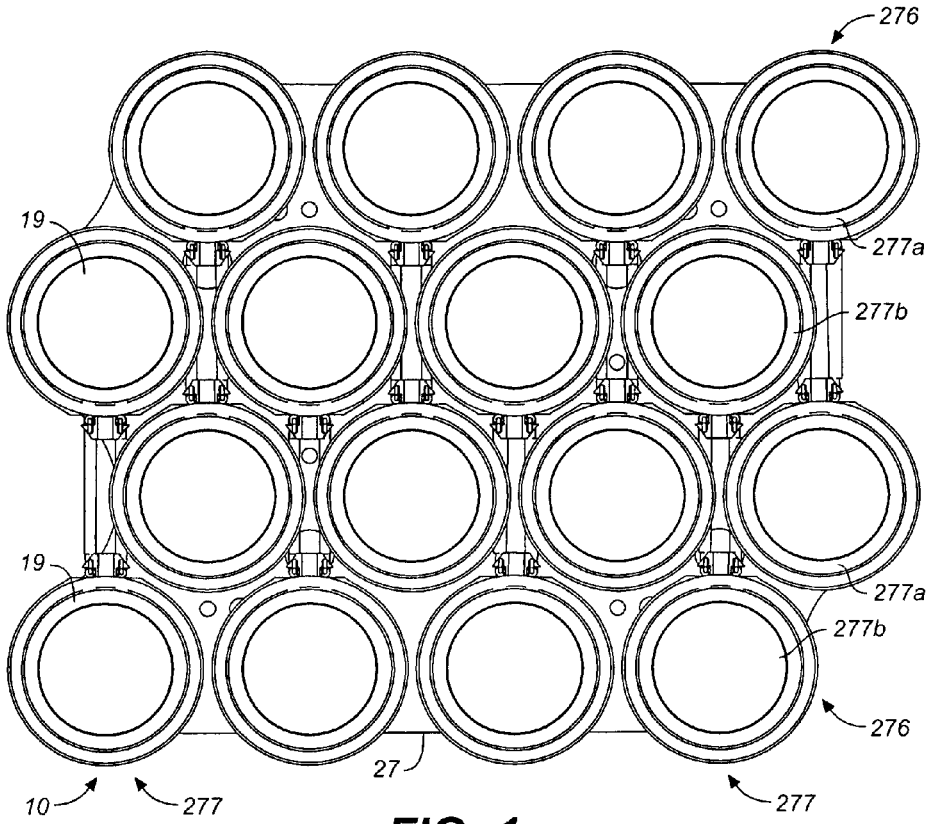
FIG. 1 is a top plan view of a transducer array module for a loudspeaker system in accordance with the invention.

In the loudspeaker and loudspeaker system of the present invention, a desired substantially uniform beam form can be produced over a relatively wide operating frequency range from a plurality of transducer elements set in a transducer array configured, sized and powered as described herein. The beam form, whether fixed or adjustable, can be achieved substantially entirely through signal processing, with different beam forms being achievable for different applications.

As used herein, "beam form" refers to the shape of the sound beam produced by a loudspeaker at any given frequency. (The term "polar pattern" is also used in the field of loudspeaker acoustics to describe a beam form.) The shape is the magnitude of the sound pressure measured spherically around the loudspeaker, and is typically plotted as a linear or log ratio to the main axis or strongest axis of sound beam. The total angle at which the sound pressure is either 3 dB or 6 dB weaker than the main axis is referred to as the "beam width." Usually an ideal beam form exhibits rapid reduction of sound pressure at angles larger than the beam width. This is exemplified by a "V" shape in the beam form. As described herein, certain, relatively complex implementations of the invention provide the ability to dynamically create various shapes in the beam form, and to therefore render the beam form adjustable, with the beam form either being kept constant over the operating frequency range or, if desired, being varied at different frequencies. In another described and simpler implementation, a beam form can be created that, while it remains fixed (non-adjustable), is relatively ideal in shape (sharp drop-off outside the beam width and well attenuated side lobes) over the operating frequency range.

Before describing the illustrated embodiment of the transducer array of the invention, the following desired attributes for the transducer element array are noted:

First, the transducer elements of the transducer array are relatively small so that the upper end of the operating frequency range of the transducer element array will be high enough for audio reinforcement applications. Also, the center-to-center spacing between transducer elements is preferably kept as small as possible horizontally, vertically, and diagonally. The center-to-center space between transducers determines the frequency at which grating lobes begin to appear, with closer spacing corresponding to higher frequency. Therefore, the inter-element spacing determines the upper limit to the operating frequency range of the array over which a controlled beam without grating lobes can be created. It is contemplated transducer sizes in the range of two and one-half and three inches with a nominal center-to-center spacing of slightly greater that two and one-half to three inches would constitute the upper limit of a usable system in accordance with the invention.

Second, the array of transducers is a two dimensional array having a continuous series of transducers as you traverse across the array at different angles. The dimension (number of transducers) across the transducer array vertically, horizontally, or on any diagonal needs to be adequate to allow sufficient beam forming to be achieved down to the desired low frequency end of the loudspeaker's operating frequency range. A dimension of about 36 inches allows control and beam forming down to 400 Hz, which would cover most audio applications. It is again noted that the beam form produced by the transducer array or the invention is substantially uniform in all directions about its radiation axis, i.e., at a given distance from the transducer array along the radiation axis, it maintains substantially the same width at a given frequency in any direction about the radiation axis. To achieve this, the array is approximately circular, with the fill factor in relation to a circle circumscribing the array of at least approximately 70%.

Third, the center-to-center spacing between transducer elements are preferably kept as uniform as possible. It is believed that in the most suitable implementations of the invention the center-to-center spacing between adjacent transducer elements will vary less than 10% throughout the array; however, transducer element arrays having larger center-to-center variations are possible and considered within the scope of the invention. As variations in the center-to-center spacing increase, additional signal processing may become necessary to compensate.

Fourth, while the transducer elements themselves are relatively small, the transducer design is preferably selected to maximize the diaphragm size relative to the outer dimension of the transducer. A maximized diaphragm size (for example, a one inch diaphragm for a nominal one inch transducer) is found to provide a number of advantages: it allows the operating frequency range of the transducer element array to be extended to lower frequencies; it increases the efficiency of the individual transducer elements allowing them to produce higher acoustic power; and it enhances the ability of the transducer array to avoid grating lobes at high frequencies. In regards to the formation of grating lobes at high frequencies, it is well known that the beam width of any given acoustic radiator is relatively wide at frequencies whose wavelengths are much larger than the diameter of the radiator, and relatively narrow at frequencies whose wavelengths are much smaller than the diameter of the radiator. Therefore, a larger diaphragm will result in a beam which begins narrowing at a lower frequency. Grating lobes arise when off-axis acoustic energy (i.e. energy projected at angles other than the direction of the transducer's travel) from separate transducers sums in phase (due to the difference in path length between two or more transducers and a common destination being an integer multiple of a wavelength). A transducer array according to the invention, whose elements all individually project narrow high frequency beams with little off-axis energy, will collectively exhibit attenuated grating lobes compared to an array comprised of elements which project a wide high-frequency beam. As a result, transducers with a narrow high-frequency beam width extend the high-frequency limit to the operating band of the array for a given acceptable side-lobe level.

Figure 2:
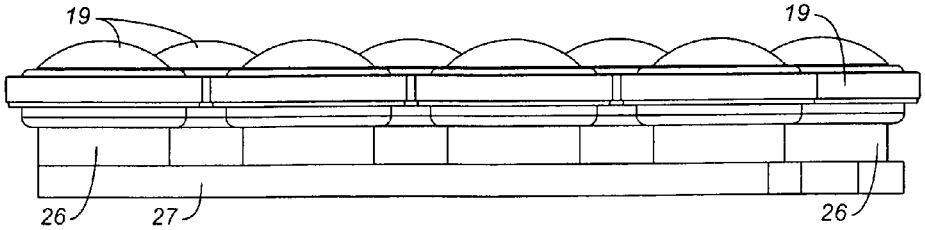
FIG. 2 is a side elevational view thereof.
Figure 3:
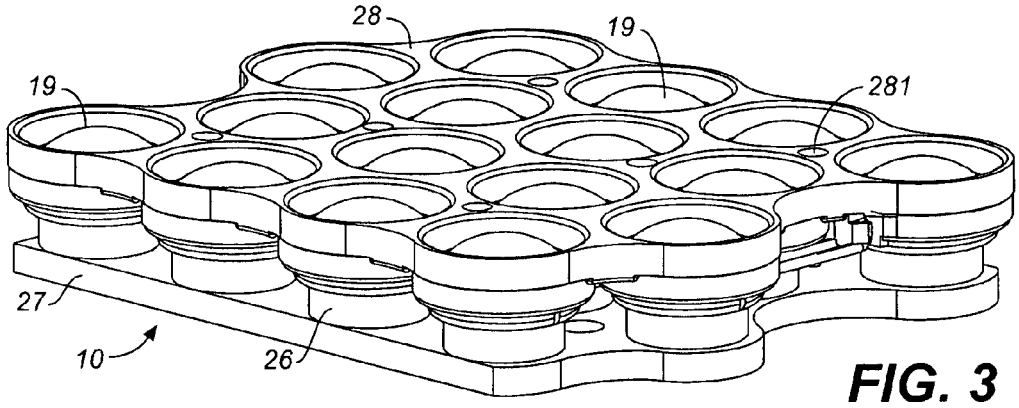
FIG. 3 is a top perspective view of the transducer array module shown in FIGS. 1-2, showing the addition of a face plate on the array module.

Referring now to the drawings, FIGS. 1-3 show a transducer element array 10 comprised of a plurality of closely packed transducer elements 19 mounted to a heat conducting mounting plate 27 preferably fabricated of a heat conducting material such as aluminum. In addition to providing a heat sink for the heat generating transducer elements, the mounting plate provides the important function of setting the position and spacing of the transducer elements within the array. The transducer elements can be mounted to the mounting plate on heat conducting spacers 26, also suitably aluminum. The spacers act to elevate the transducer elements above the mounting plate so as to create space beneath and between the transducer elements to accommodate the transducer wires. Attachment of the transducer elements to the mounting plate can be accomplished by any suitable means, such as by an attachment screw (not shown).

Figure 3A:
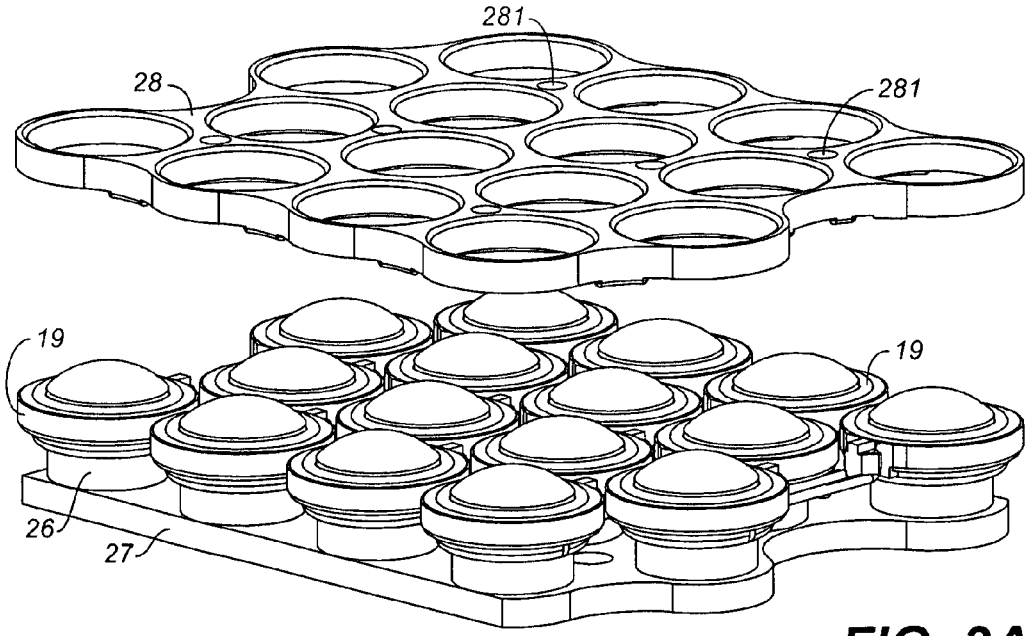
FIG. 3A is an exploded top perspective view thereof.

As shown in FIGS. 3 and 3A, a face plate 28 for the transducer element array that fits over the transducer element array can be provided so as to cover the gaps between adjacent transducer elements. This face plate, which prevents back waves that would reflect off of the mounting plate and that would be delayed with respect to the front waves, is suitably fabricated of plastic and anchored to the mounting plate by screws (not shown) that fit through screw holes 281 in the face plate and that thread into corresponding screw holes in the mounting plate.

The transducer element array 10 shown in FIGS. 1-3 is seen to form a transducer array module containing sixteen transducers that provide a two dimensional array having a continuous series of transducers as you traverse across the array at different angles. It is further seen that the perimeter of the efficiently packed transducer element array of the module has a somewhat irregular shape; however, it is found that with a sufficient number of transducer elements, this irregularity in the perimeter conditions of the array will have little effect on the beam form produced by the array, provided the overall perimeter shape substantially fills a circle that circumscribes the array. As further discussed below, without a circular configuration having an adequate fill factor, the array will lose its capacity to maintain a narrow, substantially uniform beam of sound for projecting large amounts of acoustic energy over substantial distances.

Figure 4:
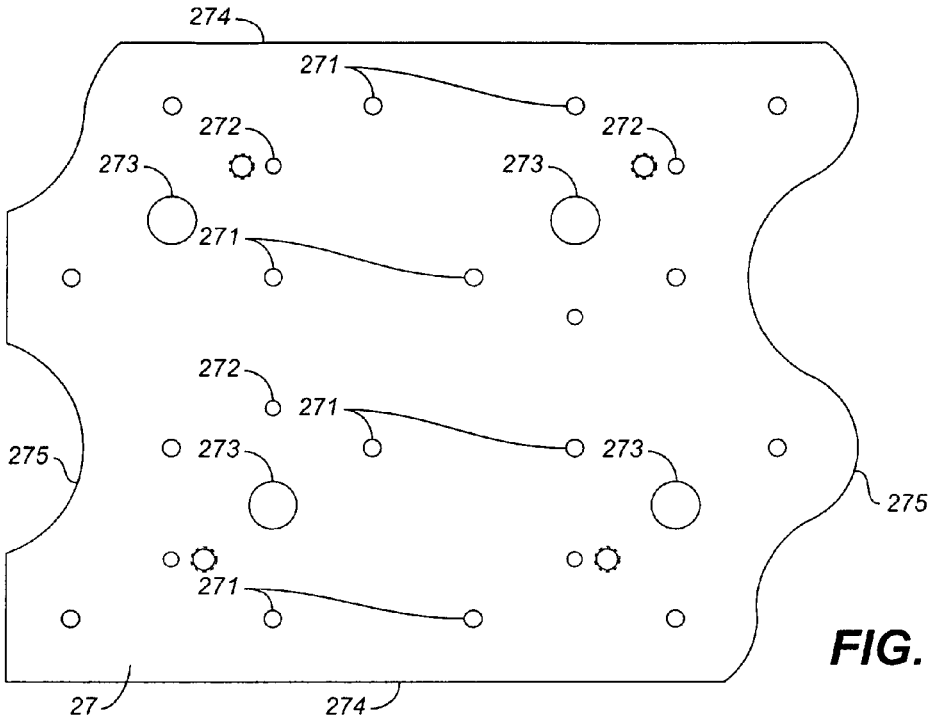
FIG. 4 is a top plan view of the mounting plate for the transducer array module shown in FIGS. 1 and 2.
Figure 5:
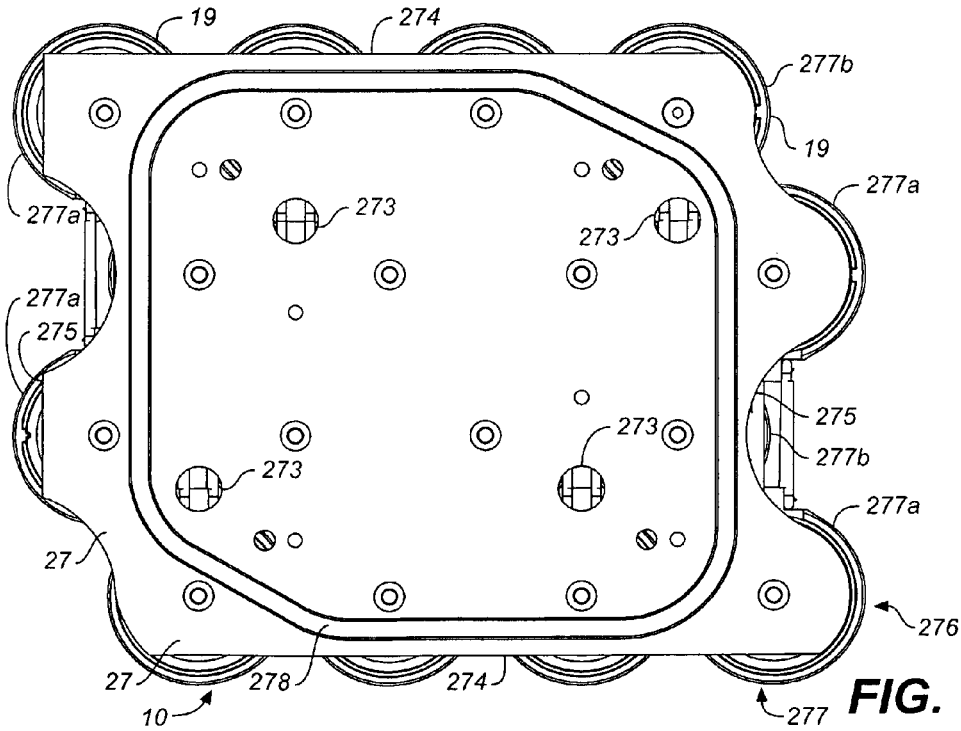
FIG. 5 is a bottom plan view of the transducer array module shown in FIGS. 1 and 2.

The mounting plate 27 to which transducer elements 19 are attached is shown in greater detail in FIGS. 4 and 5. As seen from the top (FIG. 4), the plate has a flat mounting surface 270 and includes a first series of screw holes 271 for attaching the transducer elements to the plate and a second set of screw holes 272 for anchoring the face plate. Wire holes 273 are strategically located on the plate to permit groups of wires connected to the transducer elements to be pulled through the plate. In the illustrated plate, four wire holes are provided for pulling wires for four different groups of contiguous transducer elements.

As shown in FIG. 5, the bottom of the mounting plate of a transducer array module 10 is suitably provided with an O-ring groove 278 for a compressible O-ring (not shown), which will prevent moisture from intruding into the bottom wire hole area of the mounting plate when the module is mounted to a larger loudspeaker base plate (element 102 in FIG. 12) as hereafter described.

The shape of the mounting plate as defined by its perimeter edges is chosen to allow the transducer array module to be fitted together with other like modules in a larger array of transducer elements as hereinafter described. Specifically, the illustrated mounting plate has generally rectangular shape with a first pair of parallel perimeter edges 274 and a second pair of complimentary irregular perimeter edges 275 at ninety degrees to the parallel edges. The transducers are arrayed on the mounting plate such that the array terminates in parallel perimeter rows 276 along the parallel perimeter edges of the mounting plate and in irregular perimeter rows 277 along the irregular perimeter edges of the mounting plate. It is seen that the transducer elements of the parallel perimeter rows 276 slightly overhang the parallel perimeter edges of the module's mounting plate. On the other hand, two of the transducer elements 277*a* of each irregular perimeter row exhibit such an overhang, while the other two transducer elements 277*b* are recessed from the perimeter edge. This overhang arrangement is provided to allow the transducer elements of the perimeter rows to interleave with each other when array modules can be fitted together. Such interleaving of the perimeter transducer elements will act to minimize the variation in the center-to-center spacing of the transducers at the boundaries of the modules.

Figure 6:
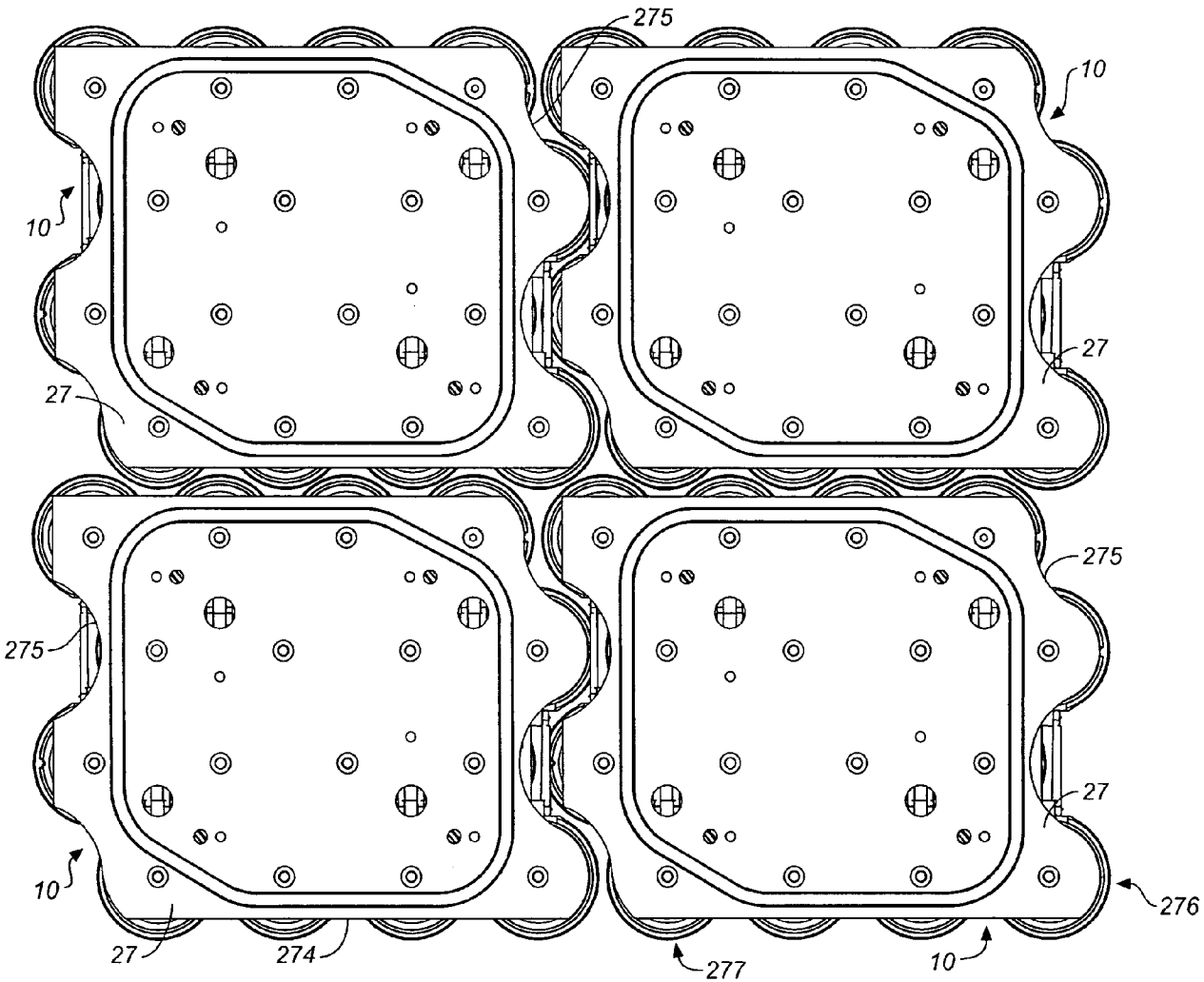
FIG. 6 is a bottom plan view of four transducer array modules illustrating the expandability of the transducer array.
Figure 7:
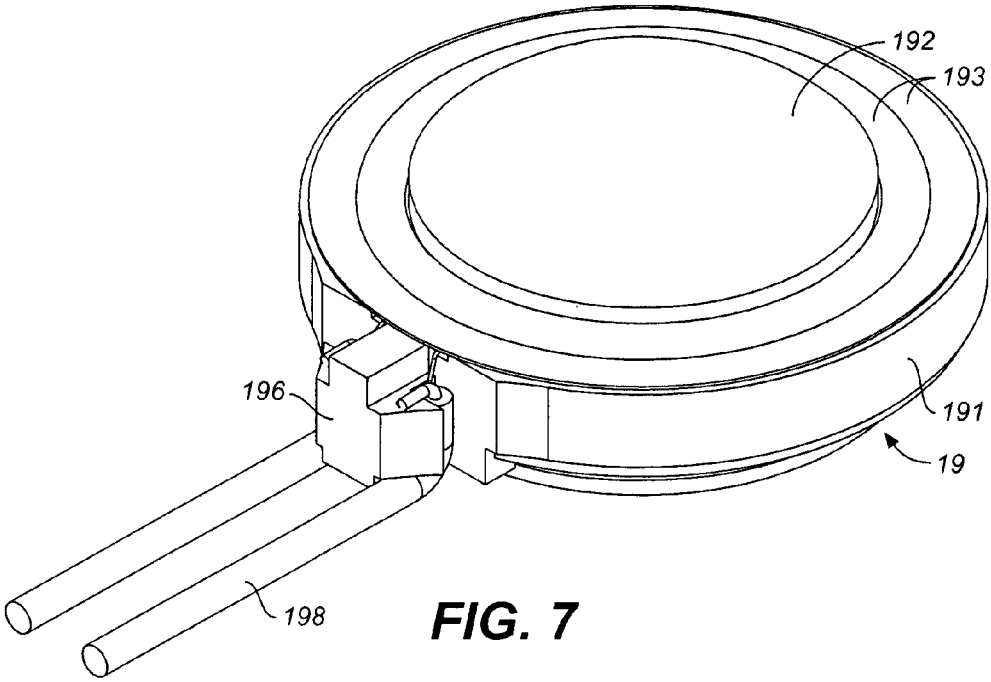
FIG. 7 is a top perspective view of one of the transducers of the transducer arrays shown in the foregoing figure.
Figure 8:
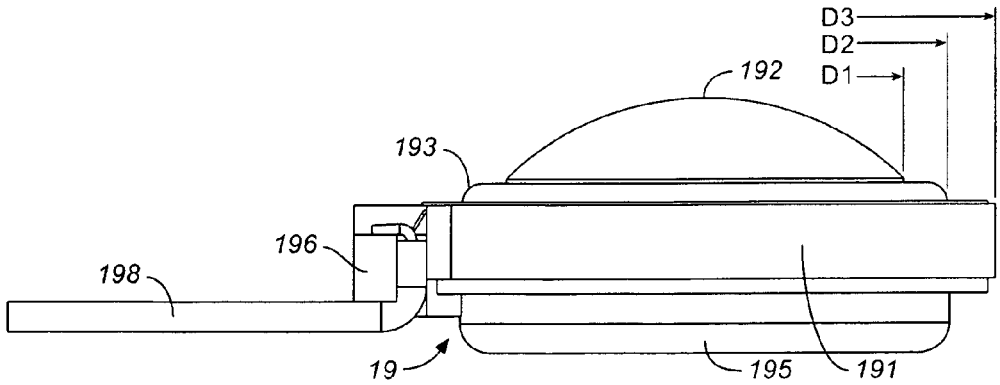
FIG. 8 is a side elevational view thereof.
Figure 9:
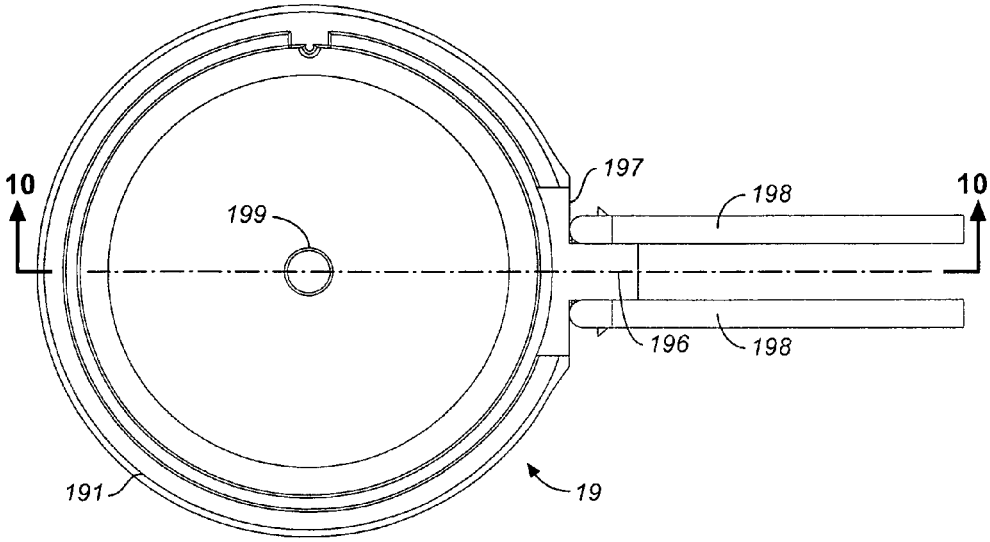
FIG. 9 is a bottom plan view thereof.
Figure 10:
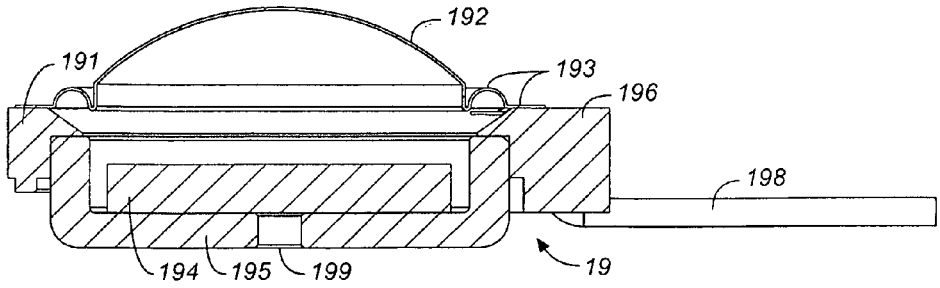
FIG. 10 is a cross-sectional view thereof taken along line 10-10 in FIG. 9.

The fitting together of transducer element array modules is illustrated in FIG. 6. FIG. 6 illustrates four identical transducer array modules 10 fitted together along their perimeter edges by fitting parallel perimeter edges 274 of one module to a corresponding parallel perimeter edges of an adjacent module, and irregular edges 275 of a module to the complimentary irregular edge of an adjacent module. Any number of modules can be fitted together in this manner in order to scale the array to a desired size.

FIGS. 7-10 show a suitable transducer element design for achieving close packing of the transducer elements on a mounting plate as described above. Transducer element 19 is a circular shaped dome tweeter, preferably capable of peak-to-peak diaphragm (dome) excursions of 4 mm or more in order to produce suitable sound pressure levels. The dome tweeter includes a support frame 191 for the tweeter's diaphragm 192, a center magnet 194 and a base 195. (It is noted that FIGS. 7-10 do not show all of the components of the tweeter and particularly the diaphragm's voice coil and a top plate that fits over the center magnet.) For close packing, it is desirable to have the outer dimension of the tweeter as small as possible. Thus, a tweeter design is preferably selected where the outer diameter of support frame 191 is limited to the diameter necessary to support the surround 193 of diaphragm 192. (Conversely, this also means the diaphragm is as large as possible relative to the overall transducer dimension, which results in a number of advantages mentioned above.) The center magnet construction contributes to the compactness of the transducer element and allows for close packing the transducer elements. It also prevents adjacent transducers from interacting with each other magnetically, which would make assembly difficult.

To further conserve space for the close packing of the transducer elements, the long wire harness conventionally provided with commercially available tweeters for remote connections is eliminated in the illustrated embodiment of the transducer element. Instead, a short tear drop wire connector 196 is provided on a flattened edge 197 of the tweeter support frame. This tear drop connection allows for the dressing of the transducer wires 198 in a relatively small space. Also, mounting the transducer element to the mounting plate 27 shown in FIG. 4 is achieved without mounting hardware that would interfere with adjacent transducer elements. This is achieved by providing a center screw hole 199 in the bottom of the tweeter base 195 for a screw attachment to the mounting plate. A corresponding screw hole (not shown) would also be provided in spacers 26. It will be appreciated that more than one screw hole could be provide for more the one screw attachment. It will also be appreciated that other non-intrusive mounting schemes could be used including, for example, gluing or the use of mechanical means of attaching the bottom of the tweeter base to the mounting plate.

Figure 11:
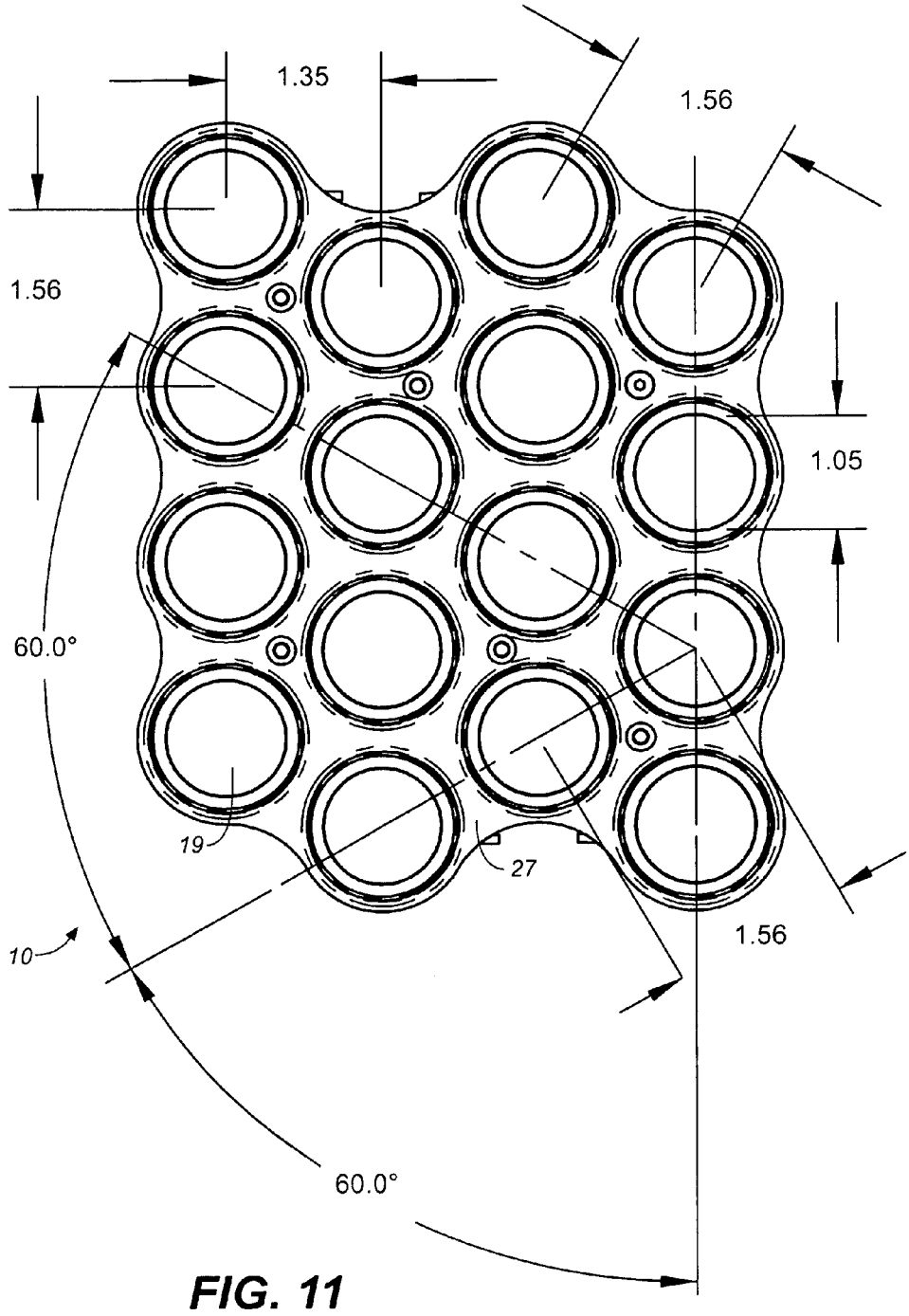
FIG. 11 is layout of the transducers elements for a transducer array module showing in more detail the arrangement and configuration of the relatively small transducer elements of the array.

FIG. 11 generally illustrates exemplary sizing and spacing dimensions for the transducer element array module 10 shown in FIGS. 1, 2, 3 and 3A. First, it is noted that each interior transducer element of the array is surrounded by and nearly in contact with six other transducer elements and produce staggered rows which result in the irregularities along ends of the staggered rows. (Irregular perimeter rows are denoted by numeral 277 in FIG. 1.) The transducers are matched, nominally one inch circular dome tweeters having a diaphragm dome diameter of 1.05 inches and a center-to-center spacing along any vertical row or diagonal of 1.56 inches. (Referring to FIG. 8, the dome diameter is indicated by D1. Further exemplary dimensions for the dome tweeters include 1.25 inches for the diameter D2 to the outside of the surround, and 1.49 inches for the outer diameter D3 of transducer's support frame 191.) The diagonals are at sixty degree angles from the vertical rows and produce a center-to-center separation or 1.35 inches between vertical rows. The center-to-center spacing between adjacent transducer elements is seen to be uniform throughout the array, which provides for a uniform density of transducers. Preferably, the center-to-center spacing between adjacent transducer elements will be vary less than 1% throughout the array, however, higher variations in spacing uniformity may be possible. The highly uniform density allows for a uniform sound field and coverage and eliminates side lobes and stray beams.

Figure 12:
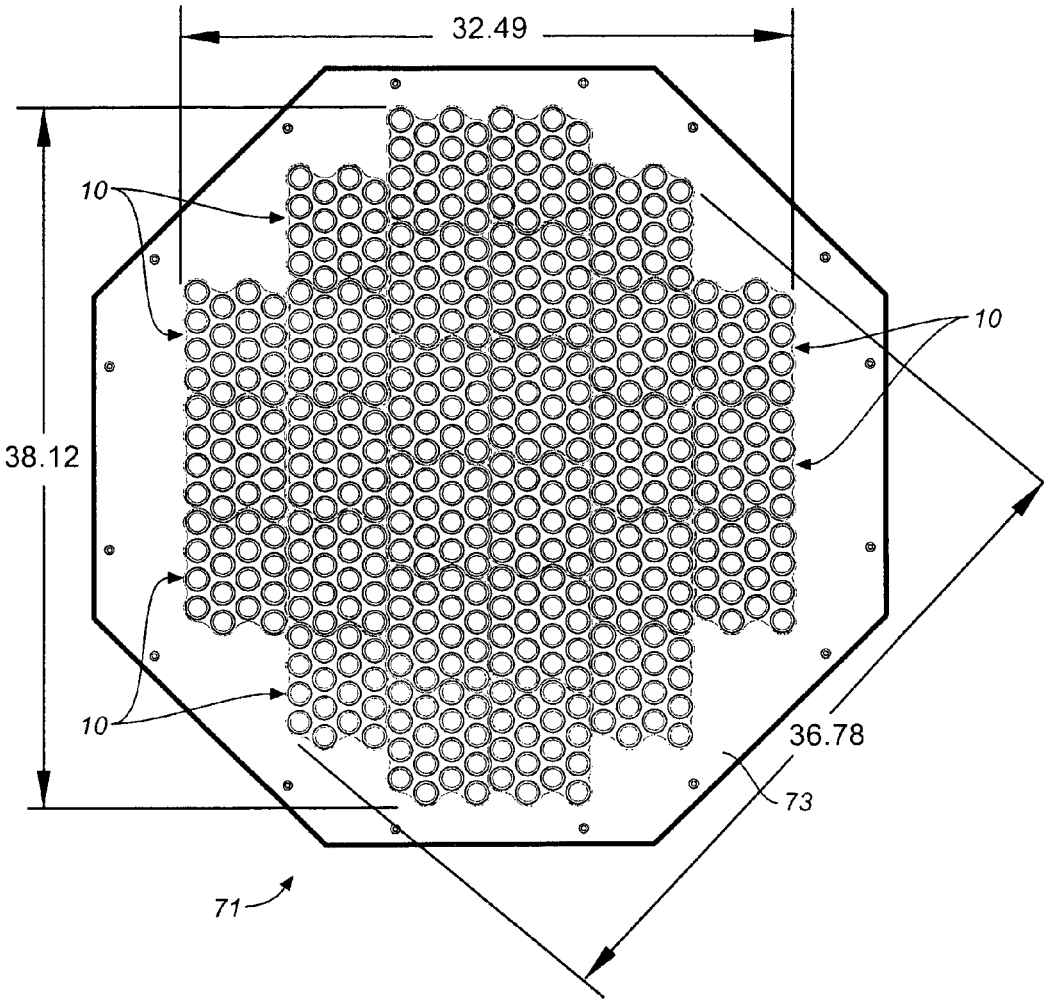
FIG. 12 is a graphical view of a plurality of transducer array modules mounted to a base plate to provide an expanded array of transducer elements.

FIG. 12 shows a larger, scaled-up transducer element array 71 comprised of twenty eight individual transducer array modules 10 as shown in FIGS. 1-3A fitted together as illustrated in FIG. 6. Each transducer array module has sixteen transducer elements 19 in the form of circularly shaped, preferably matched dome tweeters as above described, resulting in a total of 448 matched transducer elements for the entire array. The transducer elements throughout the array are seen to be packed closely together with center-to-center spacing between adjacent transducer elements being very uniform, even along the abutting perimeter edges of the array modules.

As above-mentioned, the design of the transducer element array modules, as shown in FIGS. 1-6, allows adjacent modules to be fitted together so that the uniformity of the center-to-center spacing of the transducer elements can be preserved across module boundaries. Center-to-center spacing variations of less than about 1% can be achieved across the module boundaries.

It will be understood that the expanded array shown in FIG. 12 is exemplary and that arrays having a different transducer element count can be created. It is also contemplated that arrays could be created using transducer elements that are not matched; however, this would add to the complexity of the signal processing for the loudspeaker system.

The transducer array modules shown in FIG. 12 are mounted to loudspeaker base plate 73, which preferably is a heat conductive plate such as aluminum. The modules can suitably be mounted to base plate 73 by screw attachment means (not shown). By drawing the mounting plates (element 27 in FIGS. 1-6) of the array modules down into thermal contact with the loudspeaker base plate—the above-described O-rings in the back of the modules are compressed when doing this—heat generated by the transducer elements can be transferred to and dissipated by the larger loudspeaker base plate. The base plate would, in turn, would suitably be mounted to a speaker box (not shown) for supporting the transducer element array and enclosing the transducer element wiring. The speaker box would also house a cooling system, including for example a fan, for drawing heat away from the array.

Figure 12A:
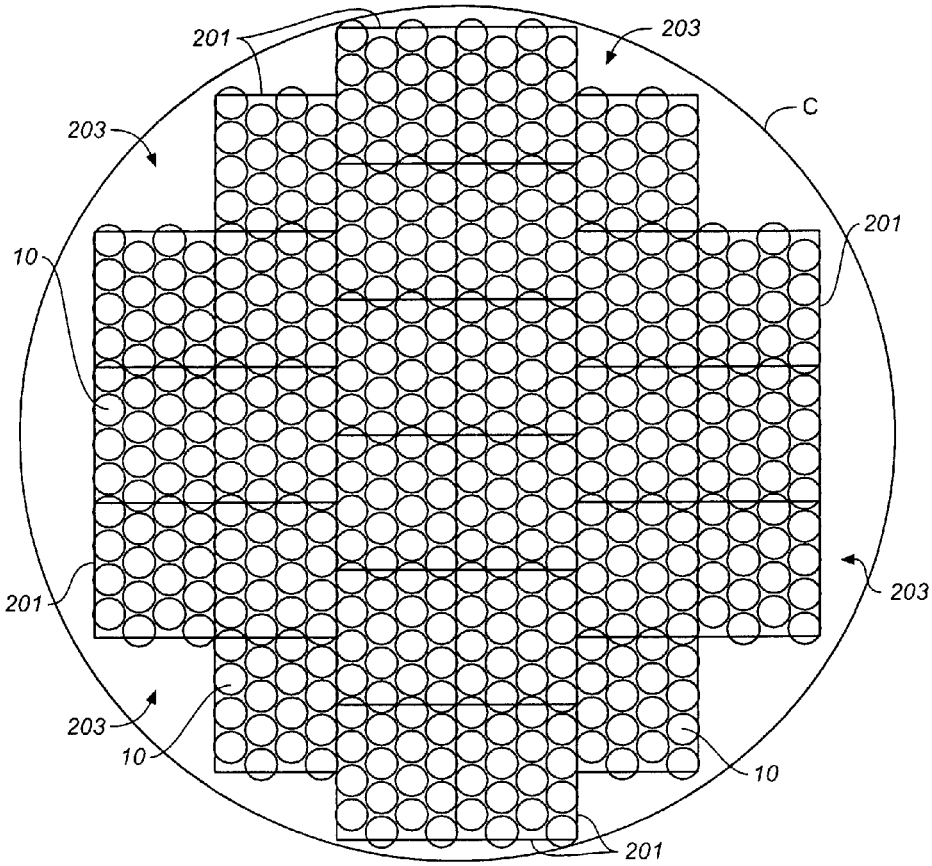
FIG. 12A is a graphical illustration of the transducer array modules shown in FIG. 12 circumscribed by a circle to illustrate the fill factor of the approximately circular array.

FIG. 12A shows the grouping of array modules 10 seen in FIG. 12 circumscribed by a circle C to illustrate how the resulting transducer array needs to be configured to satisfy the circle fill factor criteria of the invention. The ideal array shape to produce the desired uniform beam form is a circle. If the overall array shape deviates significantly from a perfect circle, its ability to create an efficient, focused, uniform beam around a radiating axis of the transducer array with a single signal processing channel is diminished. For example, a lower fill factor due to an array envelope which is significantly larger in one direction than another would result in a widening of the beam at low frequencies in the plane of the shorter array dimension. As seen in FIG. 12A, where the transducer elements are arrayed such that they do not form a perfectly circular array, some areas within the circumscribing circle C are empty. For a perfectly circular array, there would be essentially no empty area. In this case, the ratio of the area of the circle filled by the transducer elements to the empty area (the fill factor) would be close to 100%. For the modular transducer array shown in FIG. 12A, the empty areas 203 produced between the outer edges 201 of the outermost transducer array modules 10 and the circumscribing circle C is just under 25% of the total area of the circle, thus producing a fill factor of just over 75%. Arrays having a fill factor significantly below 75% could not produce the desired focused beam form without multiple signal processing channels. Signal processing adds to the complexity of the loudspeaker system and sacrifices efficiency. Below a 70% fill factor, it is calculated that the acoustic power would drop off more than 3 dB, which is a 50% decrease. A drop of more than 3 dB in efficiency is considered be unacceptable, particularly in PA applications A loudspeaker system in accordance with the invention having an upper frequency limit of 8 KHz can be achieved with 1.5 inch diameter dome tweeters as above-described having a nominal center-to-center spacing less than 1.6 inches. A system comprised of 448 high-power matched dome tweeters of this dimension packed on a one meter base plate with substantially uniform density, that is, with substantially uniform spacing between transducers of less than 1.6 inches, would be capable of producing focused narrow beam of acoustic power at relatively high sound pressure levels. A higher upper frequency could be attained using smaller transducers with a smaller center-to-center spacing. For Example, a 12 KHz bandwidth could be achieved using nominally one inch diameter transducer elements having a center-to-center spacing of slightly greater than one inch. However, the smaller transducer elements of such a system would have smaller diaphragms and voice coils, and thus less power handling capability.

It is contemplated that the upper frequency end of the loudspeaker system of the invention could be extended for a given size of the transducers through signal processing, and particularly through the use notch filters, to prevent side lobes and grating lobes in the higher frequency ranges. It is also contemplated that upper frequency limit could be extended adding a waveguide structure in front of transducer elements of the array.

Figure 13:
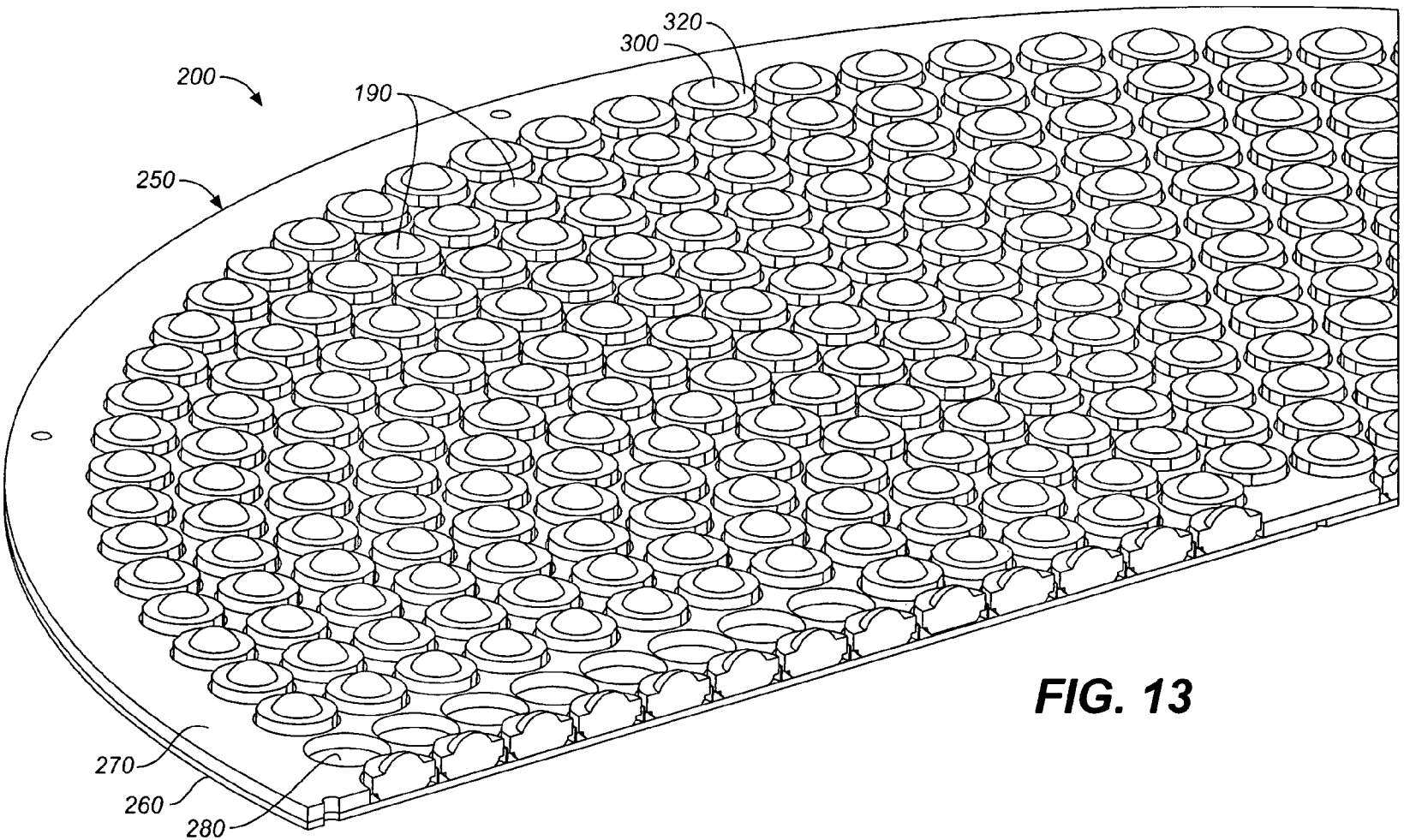
FIG. 13 shows an alternative arrangement of closely packed transducer elements on a base plate for producing a transducer array in accordance with the invention.

FIG. 13 shows a possible implementation of the transducer element array in accordance with the invention wherein within the circular fill factor is close to 100%. In this embodiment, the transducer elements 190 of the array 200 are mounted to a flat, circular mounting plate structure 250 in concentric rings. This mounting plate structure is comprised of a lower heat conducting base or mounting plate 260, suitably fabricated of aluminum, and a top plate 270 suitably fabricated of plastic. The plastic top plate 270 is provided with closely spaced mounting holes 280 sized to receive and fix the location of the individual transducer elements. The top plate and base plate are suitably glued together by commercially available glue, such as Sikaflex 221. The transducer elements are preferably attached directly to the base plate 260 so that the base plate acts as a heat sink for the transducers. This attachment can be achieved by gluing the back of the transducer, which is metal, to the base plate using commercially available thermally conductive glue, such as Loctite 383.

The small transducer elements 190 of the FIG. 13 transducer array configuration are also suitably in the form of small dome tweeters. The illustrated dome tweeters have a dome diaphragm 300 and a diaphragm assembly frame 320, which surrounds the diaphragm and the transducer's magnetic assembly (not shown); the diaphragm assembly frame also defines the overall physical shape and dimensions of the transducer element. Small dome tweeters that produce high power and that have physical dimensions in the range of one to two inches in diameter are commercially available.

A loudspeaker system having a transducer element array with a concentric ring distribution as shown in FIG. 13 and having an upper frequency limit of 6 KHz can be achieved with two inch outer diameter circular dome tweeters having a nominal center-to-center spacing two inches. Approximately 256 to 270 high-power matched dome tweeters, each having a 32 mm diameter dome with a four millimeter excursion, can be packed in concentric rings onto a one meter circular mounting plate structure with satisfactory uniformity in the spacing between transducer elements (relatively uniform density). However, it is noted that the density of the tweeters in this embodiment is not as uniform as the density of the tweeters in the embodiment illustrated in FIGS. 1-12. Using two inch dome tweeters in this concentric ring distribution, center-to-center spacing between transducers of between 2.05 inches and 2.15 inches have been achieved. Such a system would be capable of producing focused narrow lobe of acoustic power at relatively high sound pressure levels.

In another concentric ring configuration as shown in FIG. 13, an array of four hundred and forty customized dome tweeters having an overall physical diameter of 1.3 inches, and 23 mm domes were packed in concentric rings onto a one meter diameter circular mounting plate structure with center-to-center spacings ranging from 1.5 to 2.12 inches (a relatively high variation) and with an average spacing of approximately 1.75 inches. With each tweeter being driven at 4 watts, 141 db continuous power and 153 db peak power at one meter over the frequency range of the system was measured.

It shall be understood that the transducer elements in the foregoing described embodiments are not intended to be limited to circular transducers. It would be possible to create an array of transducer elements having other physical shapes, such as a transducer having a square diaphragm assembly frame, which meet the size, spacing and fill factor requirements of a transducer element array in accordance with the invention.

Figure 14:
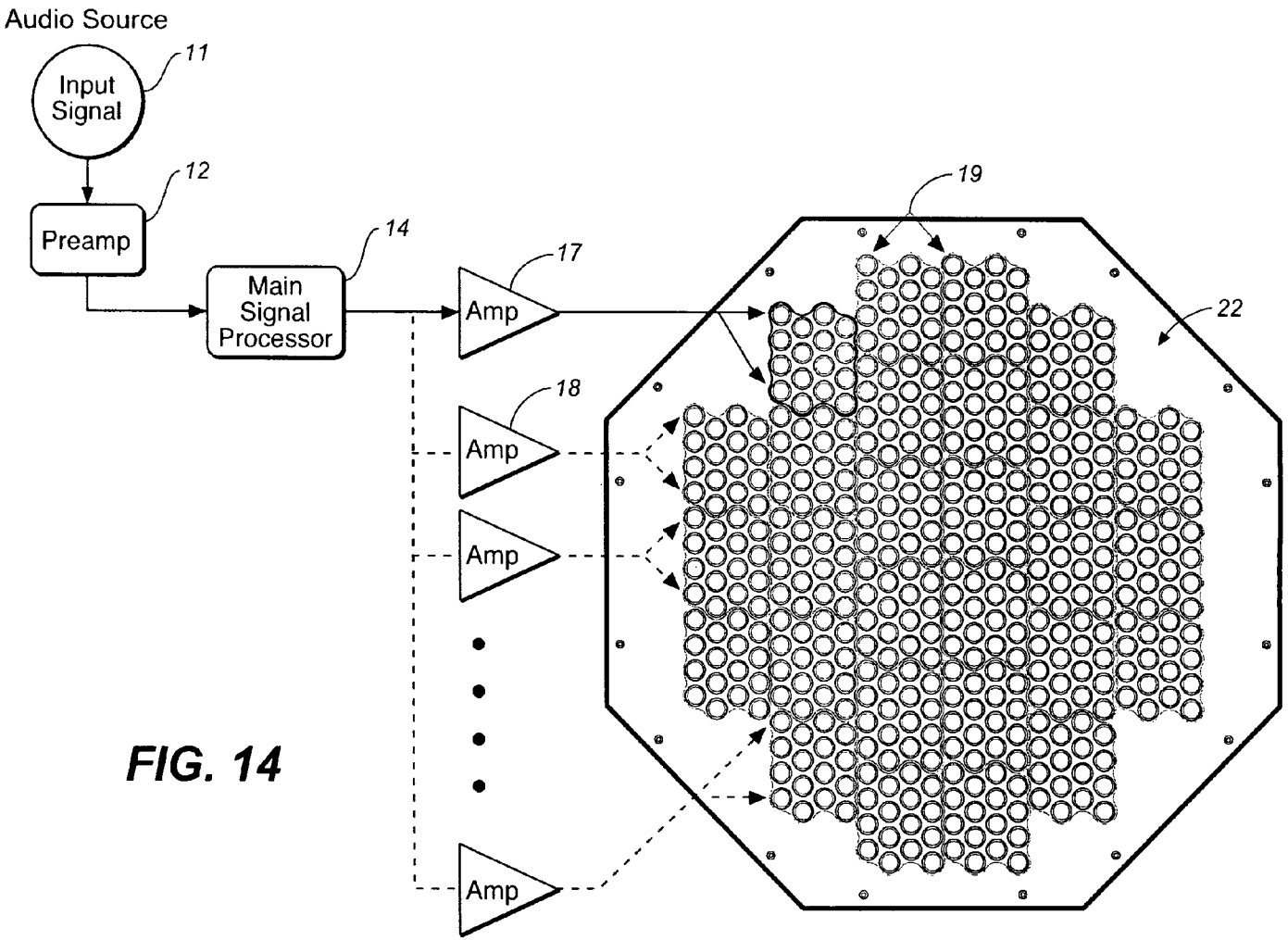
FIG. 14 is graphical view of a closely packed transducer array and a single channel input control circuit for powering all the transducers of the array from a signal input for producing a fixed beam of sound.
Figure 15:
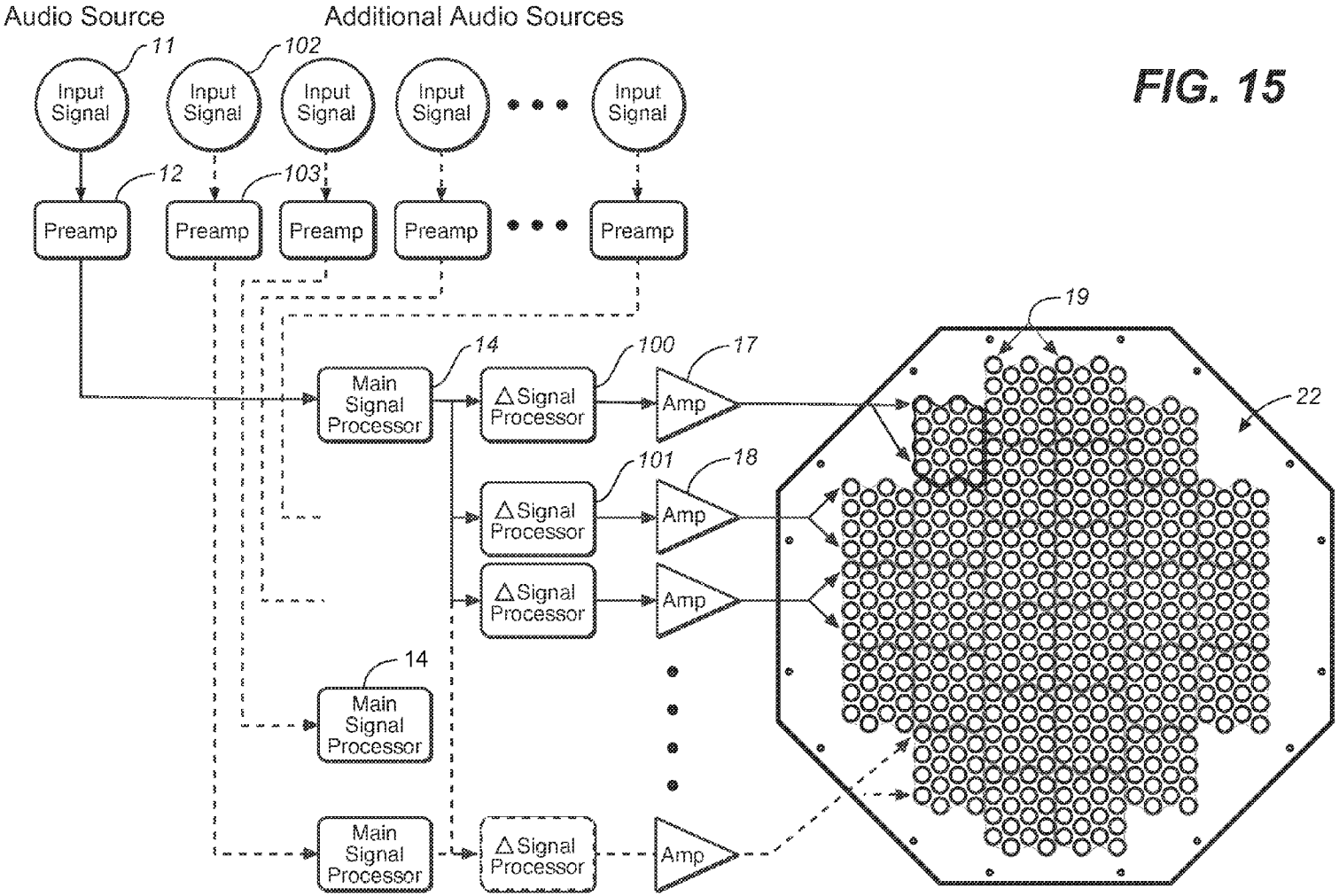
FIG. 15 is graphical view of a closely packed transducer array and a multi-channel input control circuit for powering all the transducers of the array from either signal input or multiple inputs for producing an electronically adjustable beam of sound.

FIGS. 14 and 15 show different audio input control schemes for powering the transducer element array described above. The simplest embodiment is shown in FIG. 14 and can produce fixed acoustic outputs having a desired beam form. A more complex implementation is shown in FIG. 15. With this implementation, acoustic outputs capable of dynamic adjustment can be produced. Both schemes are illustrated and described in reference to the transducer array having the packing distribution shown in FIG. 12.

Referring to FIG. 14, the input audio control scheme for the loudspeaker system is illustrated in block diagram form. The loudspeaker system receives an electronic audio signal 11, in either analog or digital form, from a sound system mixer, microphone, recording, or the like, generally from a balanced XLR audio connector. The signal is fed to a preamplifier 12 to receive the balanced signal. The preamplifier may adjust the level of the signal through gain or attenuation and may also apply rejection for common mode interference and signals outside the audio band. Conventional professional audio input circuitry can be used for this preamplifier. If the input signal 11 is digital audio, the preamplifier will include a D/A converter.

The output from the preamplifier is fed to a main signal processor 14, which provides the functions described above. The signal processor output is, in turn, applied to an audio power amplifier 17 to amplify the voltage and deliver suitable current to the transducers 19. Additional identical amplifiers 18 may be used to distribute the load of the transducers among more amplifiers. The transducers 19 are connected to the amplifier(s) outputs in either series or parallel combinations, or both, such that each transducer receives the same signal.

The wattage of the amplifier(s) and connection configuration to the transducers is preferably selected to produce approximately 10 to 20 Vpk to each transducer at its maximum for the invention function in its intended form. There are 448 transducers used in the embodiment illustrated in FIG. 14. The transducers 19 are suitably 4 ohm nominal impedance. The transducers can be connected in parallel on one or several identical amplifiers although the resulting impedance will be lower than most conventional audio amplifiers can withstand unless a very large number of additional amplifiers are used.

Figure 16:
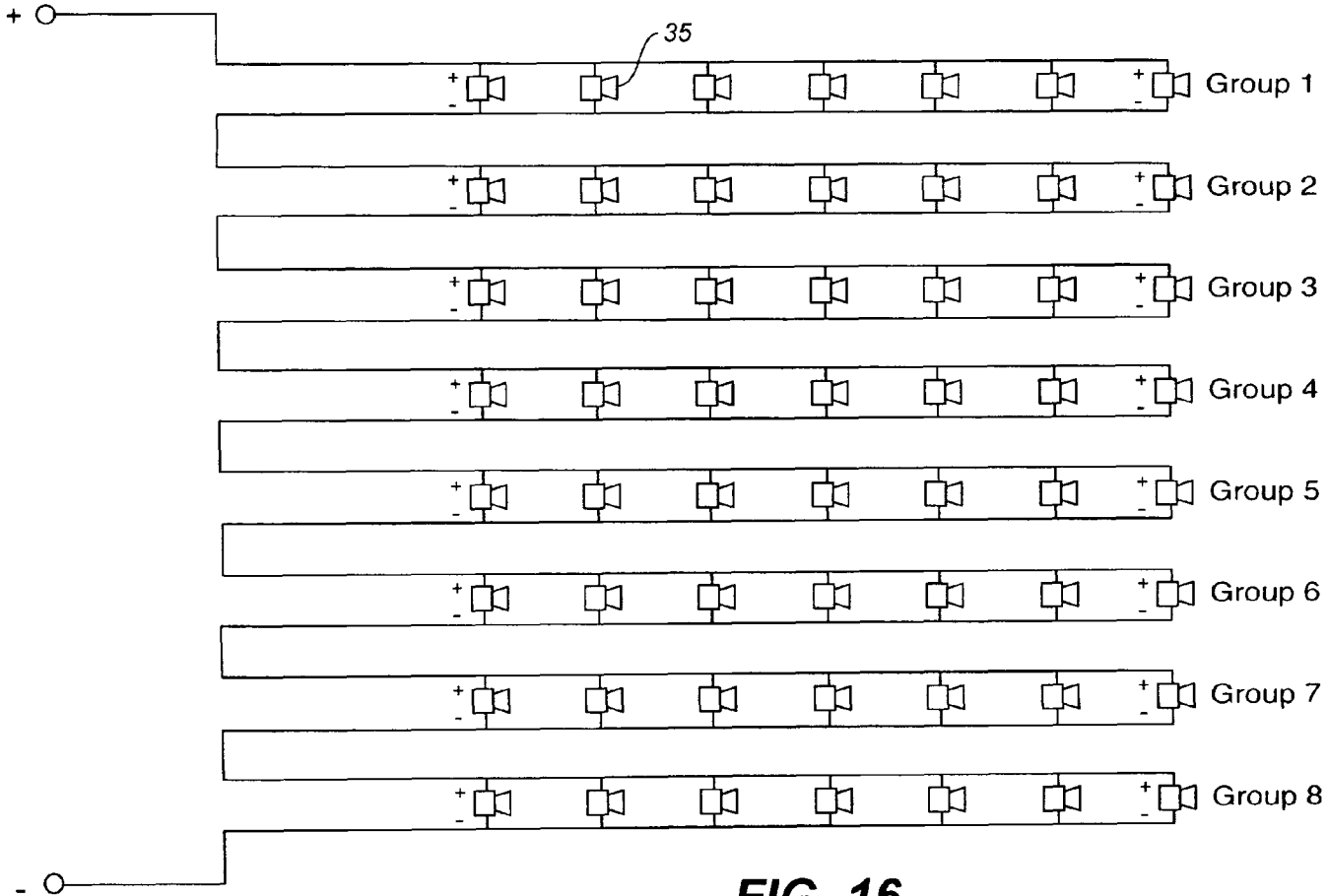
FIG. 16 is a diagram of an exemplary grouping and connection scheme for the transducer element array shown in FIG. 14 where the array is powered from a single amplifier.

To provide a more conventional load impedance for the amplifiers, the transducers are connected in a series-parallel combination. FIG. 16 depicts the series-parallel connection circuit. In this connection circuit there are eight parallel groups. Each group has seven transducers 35 connected in parallel, resulting in a nominal impedance of 0.57 ohms for each group. The eight groups are connected together in a series fashion resulting in a total impedance for the entire circuit of 4.57 ohms. This impedance is a suitable load for each amplifier. Each transducer receives ⅛th of the total amplifier voltage with the circuit shown in FIG. 16. The amplifier therefore must produce at least 80 Vpk to satisfy the requirement of 10 Vpk available to each transducer. To achieve that voltage the amplifier must have a rating of approximately 800 W into 4 ohms. The circuit shown in FIG. 16 connects 56 transducers. Referring to FIG. 14 the entire array of transducers (22) is comprised of 448 transducers. The transducers are divided into eight branches, each containing 56 transducers. Each branch of 56 transducers is wired as shown in FIG. 16. One amplifier is used for each branch resulting in eight identical amplifiers for the entire system. Since all amplifiers are fed from the same main signal processor 14, as shown in FIG. 14, and all amplifiers are identical, each transducer receives an identical signal. With this configuration of the invention, since all transducers receive an identical signal, any arbitrary grouping of transducers can be used to create each of the eight branches.

The voltage gain for each amplifier 17 is preferably set to 20 dB, and is matched between amplifiers. This allows the main signal processor 14 to operate from a supply voltage of approximately +/15 VDC, suitable for op-amp analog signal processing. Similarly the preamplifier 12 operates from the same power supply voltage and receives an audio input signal 11 in the range of 1 Vpk to 10 vpk maximum. Additional voltage gain can be applied in either the preamplifier 12 or main signal processor 14 to allow the system to reach maximum voltage at the amplifier outputs as needed for different types of audio input signal levels.

Alternatively, the same result can be obtained by using a fewer or greater number of amplifiers and any combination of load connections, provided the peak voltage available to each transducer is at least +/−10 Vpk and they all receive the same signal (all must be connected with the same polarity as well). The power and voltage requirements of each amplifier must be adjusted accordingly. As the number of amplifier channels increases, the maximum being one for every transducer (448 amplifiers), a further variation of the invention can be applied allowing a flexible or more tailored beam width at each frequency. This is accomplished by grouping the transducers into each of several amplifiers where each amplifier produces a different signal to the group of transducers. In this case multiple signal processors, one for each amplifier, are required to obtain the benefit of a flexible or more tailored beam width. The greatest degree of flexibility is achieved when there is a separate amplifier and signal processor for each transducer. The signal processors must produce a different complex frequency response from each other for each transducer. The unique complex frequency response of each signal processor to achieve a particular beam form at each frequency must be solved using the Kirchhoff-Helmholtz integral theorem and associated mathematical framework, taking into account the placement of the transducer elements and boundary conditions.

In the embodiment shown in FIG. 14, it is seen that the main signal processor 14 is applied prior to the amplifier inputs to achieve the desired beam form produced by the transducer element array. The signal processor modifies and adjusts the signal in the following way:

It attenuates frequencies above and below the operating frequency range prescribed by the array dimensions to prevent those frequencies from widening the beam or producing undesirable side lobes.

It shapes the overall frequency response so the loudspeaker system is flat or compensated for air loss for long throw applications.

It provides rms voltage limiting, consequently limiting the average power applied to each transducer to protect them from damage or failure due to over-heating.

It provides peak voltage limiting at frequencies below the resonance of the transducer to protect them from over excursion damage and excess distortion.

It provides notch filters or band eliminating filters at high frequencies where grating lobes begin to occur.

The exact parameters of each of the signal processing functions depend on the particular transducer selected for the array. The method for optimizing the parameters is based on iterative measurements of frequency response at many angles and distances around the front of the array, and experimenting with settings of limiters to determine a safe level of power and excursion for the transducer.

Figure 17:
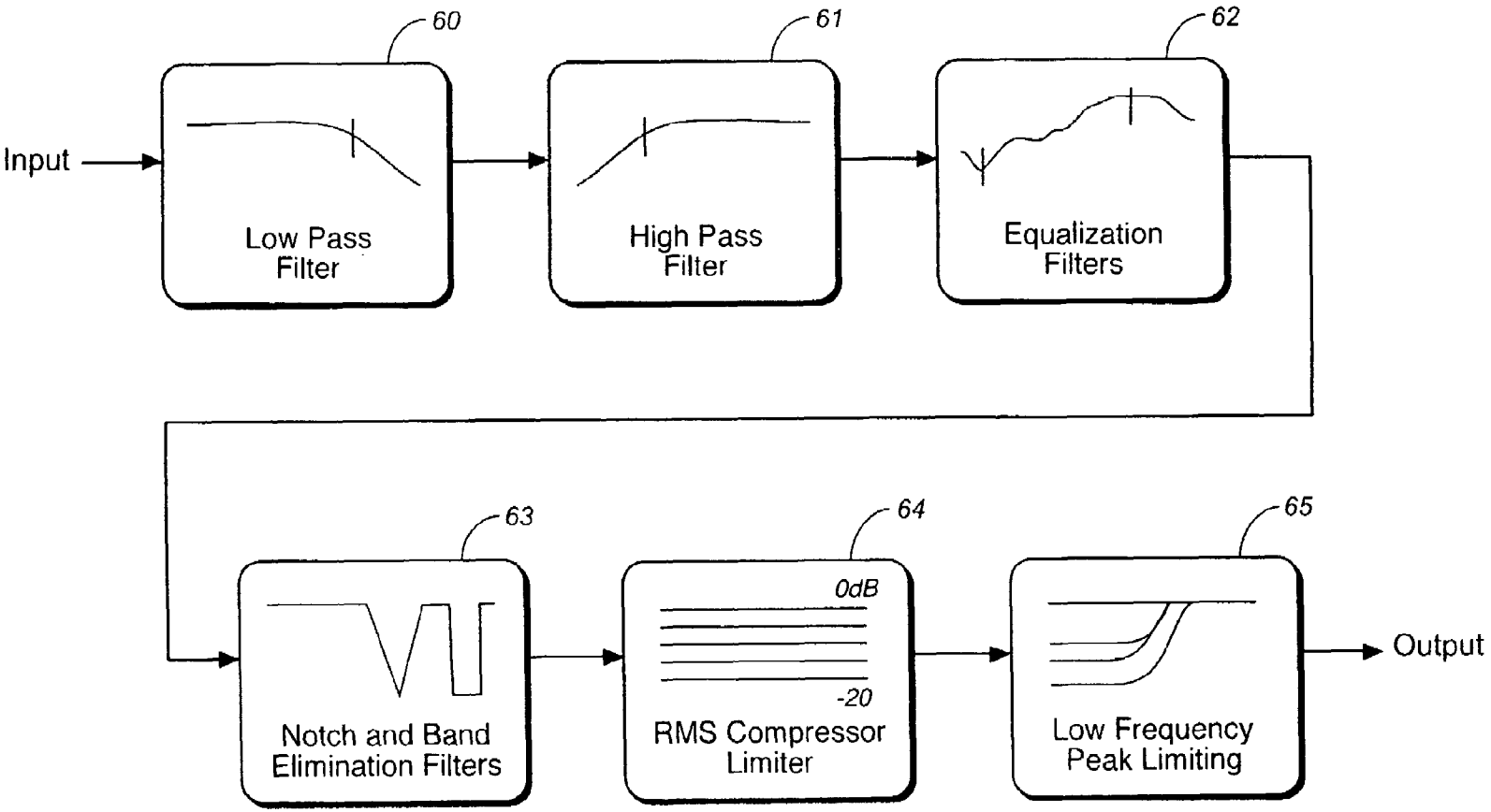
FIG. 17 is a graphical representation of the functional blocks of an exemplary signal processor of the input control circuits shown in FIGS. 14 and 15.

FIG. 17 illustrates these functions inside the main signal processor. Each of the main functions is shown as a separate block. In practice these functions may be combined into one circuit, and the functions do not need to be performed in the order shown. Low-pass filter 60 attenuates high frequencies above where the transducer array no longer produces a suitable beam width and generates many grating lobes and side lobes at many angles. The low-pass filter is generally set between 8 to 16 kHz depending on the measured acoustic performance and polar pattern of the transducer array. A steep roll off in this filter is desirable to prevent undesirable side lobes from occurring. The invention as implemented used a second order low-pass filter with a resonant frequency of 10.3 kHz, and a Q of 2.2 to produce boost around frequencies in that range. Additionally several first order low-pass filters are added to this to produce a steeper roll off above 14 kHz.

The next block is the first order high-pass filter 61 and is set to a 290 Hz. The high-pass filter may be in the range of 200 to 800 Hz depending on the transducer used in the array. A higher order roll off may be necessary as determined by acoustic measurement of the array and reliability tests of the transducer, since low frequencies (below the transducer's resonant frequency) will produce large and potentially damaging excursions on the relatively small transducer diaphragm.

The equalization filter block 62 is comprised of any number of filters to produce the desired overall acoustic frequency response of the entire loudspeaker system. This is generally accomplished by acoustic measurement of the entire loudspeaker system. An iterative measurement and adjustment methodology can be used to achieve the desired overall response.

Next, the notch and band elimination filters 63 are tuned at frequencies where unwanted grading lobes or side lobes occur in the beam form produced by the transducer array. The setting of these filters is based on acoustic measurements of the entire transducer array by identifying and attenuating frequencies that project energy towards the side of the surface of the transducer array.

Figure 18A:
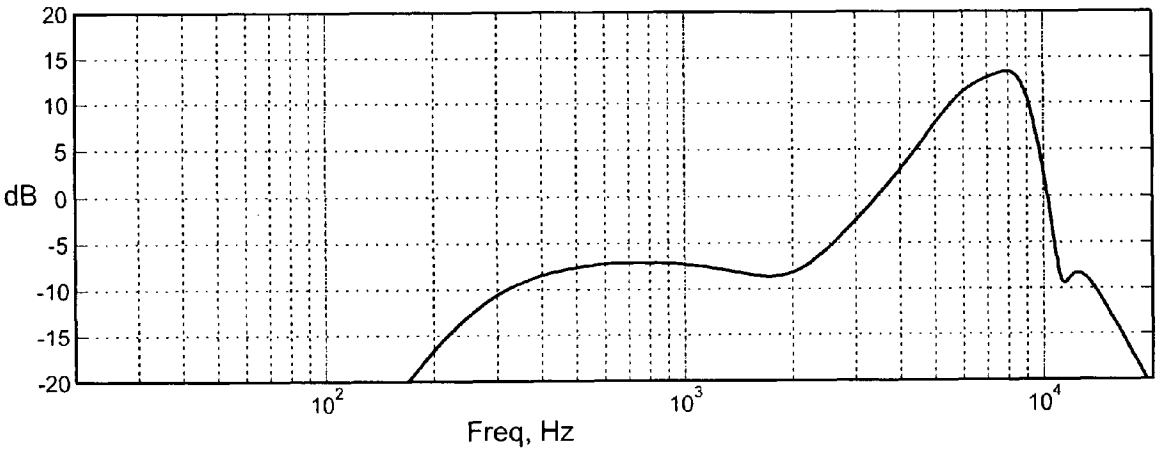
FIGS. 18A and 18B is an exemplar of the combined amplitude and phase responses of the functional blocks of the signal processor shown in FIG. 17.
Figure 18B:
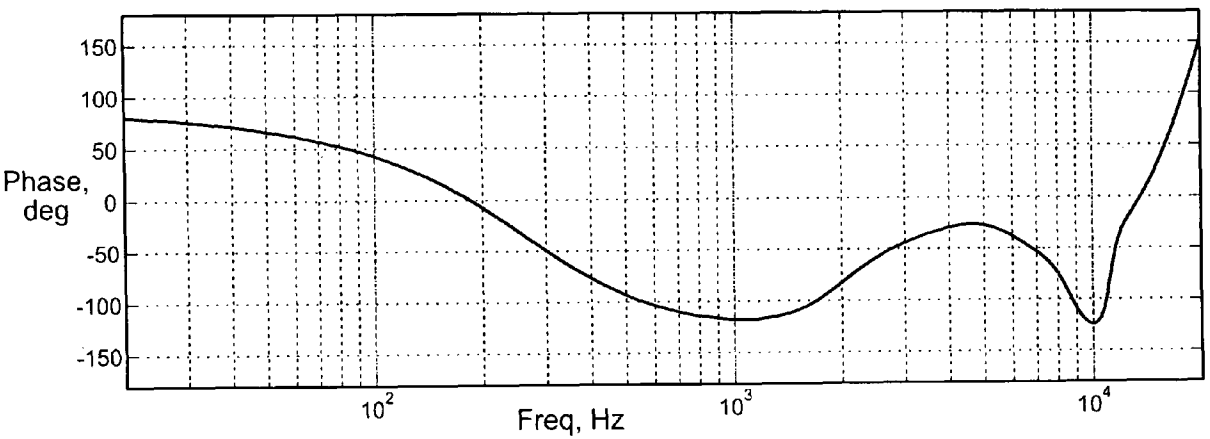

In practice, the functions contained in blocks 60, 61, 62, 63 are combined together and implemented in several op-amp analog circuits since they all operate as linear filters. The combined electrical response of these functions is shown in FIGS. 18A and 18B. It is noted that this combined response, with its emphasized high/mid-frequency band is particularly applicable for long throw applications, where attenuation of acoustic power at high frequencies over large distance is compensated for.

An rms compressor limiter 64 is introduced to protect the transducers from over temperature damage. The settings of this limiter are obtained from thermal experiments on the transducers. A low frequency limiter 65 is applied to protect the transducer from over excursion damage. The settings of this limiter are obtained from reliability experiments on the transducers.

Referring now to FIG. 15, a more complex version of the input audio control scheme for the loudspeaker system is presented as additional components are added. Each element adds further control, performance, and features to the invention. If one or more Δ signal processors 100, 101, 102 are added to the input of each amplifier, and fed by the main signal processor 14, additional control of the loudspeaker beam width at various frequencies can be obtained. Any number of Δ signal processors and amplifiers can be added. As quantity of Δ signal processors increases or approaches or matches the number of transducers in the array, a higher and higher degree of beam width and beam form flexibility is achieved. The transducers must be selectively grouped when quantities of amplifiers and Δ signal processors are less than the number of transducers but greater than one. The Δ signal processor is a complex filter, each one potentially having a unique frequency response. In any of these configurations the frequency response function of the Δ signal processors is determined by either experimentation or more preferably by modeling using the Kirchhoff-Helmholtz integral theorem taking into account placement of the transducer elements and boundary conditions to create different sound field characteristics and beam form. Applying these principles, the loudspeaker system can be scaled to any size array providing very large surface suited to an entire room allowing three dimensional sound to be created. This scaling is accomplished efficiently by adding more and more transducer modules (a shown in FIG. 6) together. Each module could preferably include an integrated amplifier and Δ signal processor for each of its 16 transducers, providing an efficient and simplified scheme for expansion.

Further shown in FIG. 15 are additional audio inputs 102 and associated preamplifiers 103.

Any of the above signal processing system and audio input can be implemented as analog or digital with A/D and D/A converters applied between sections. As the number of signal processing channels increase, the signal processing is more practical to implement digitally.

While variations of the invention have been described in the foregoing specification in considerable detail, it shall understood that it is not intended that the invention be limited to such detail or the described variations. It will be appreciated that variations of the invention other than described would be possible and within the scope of the invention.

What we claim is:

1. A loudspeaker system for producing a directional beam of sound comprising a plurality of transducer mounting plates having complementary perimeter edges that allow the mounting plates to be fitted together, said complementary perimeter edges including irregularly shaped edges wherein two mounting plates can be fitted together such that an irregularly shaped edge of one mounting plate mates with an irregularly shaped edge of the other mounting plate, and a plurality of relatively small transducer elements mounted to each of said transducer mounting plates, said transducer elements being arranged in a closely spaced relationship on each of said mounting plates to form individual transducer array modules, the transducer elements of each of said transducer array modules having a center-to-center spacing that is relatively uniform throughout said array module, and outermost transducer elements of each of said transducer mounting plates being position along each of the perimeter edges of the transducer mounting plate such that a substantially uniform center-to-center spacing between transducer elements of the transducer array modules is substantially maintained across contiguous transducer array modules when the transducer array modules are fitted together by fitting together the mounting plates of the transducer array modules along their complimentary perimeter edges, wherein, when fitted together, the transducer array modules form a larger transducer array and wherein the transducer elements of each transducer array module of said transducer array can be driven by a signal input such that of each of the contiguous transducer array modules produces an acoustic output that combines with acoustic outputs of other transducer array modules to produce an acoustic output from the transducer array in the form of a focused directional beam.

2. The loudspeaker system of claim 1 wherein the transducer elements of the fitted together transducer array modules fill at least approximately 70% of a circle circumscribing said transducer array.

3. The loudspeaker system of claim 1 wherein the transducer elements of the fitted together transducer array modules combine to form a larger transducer array that has a generally rectangular block form and that fills at least approximately 75% of a circle circumscribing said transducer array.

4. The loudspeaker system of claim 1 wherein the center-to-center spacing between the transducer elements of the transducer array modules is between about one and about two inches, and wherein the center-to-center spacing between the outmost transducer elements of any one transducer array module and the outermost transducer elements of a contiguous transducer array module is between about one and about two inches.

5. The loudspeaker system of claim 4 wherein said transducer elements of said each of said transducer array modules have a circular shape with a characteristic diameter and wherein the diameter of said transducer elements of each of said transducer array modules is between about one and about two inches.

6. The loudspeaker system of claim 1 wherein the transducer elements of each of said transducer array modules are dome tweeters.

7. The loudspeaker system of claim 6 wherein the dome tweeters of each of said transducer array modules have a diaphragm dome diameter of approximately one inch and have a center-to-center spacing of approximately 1.5 inches and wherein the center-to-center spacing between contiguous dome tweeters of adjacent transducer array modules also have a center-to-center spacing of approximately 1.5 inches.

8. The loudspeaker system of claim 7 wherein each of said transducer elements is capable of producing peak-to-peak diaphragm excursions of at least about 4 mm.

9. The loudspeaker system of claim 6 wherein the dome tweeters on said transducer array module are arranged in staggered rows on said mounting plate and overhang the mounting plate such that the dome tweeters interleave when the transducer array modules are fitted together.

10. The loudspeaker system of claim 1 wherein each of said transducer mounting plates is heat conducting, and wherein the transducer elements of each of said transducer array modules is in thermal contact with its heat conducting mounting plate.

11. A loudspeaker system for producing a directional beam of sound comprising a plurality of generally rectangularly shaped transducer mounting plates having complementary perimeter edges that allow the mounting plates to be fitted together, said complementary perimeter edges including at least two opposed irregularly shaped edges wherein two mounting plates can be fitted together such that an irregularly shaped edge of one mounting plate mates with an irregularly shaped edge of the other mounting plate, and a plurality of relatively small transducer elements mounted to each of said transducer mounting plates, said transducer elements being arranged in a closely spaced relationship on each of said mounting plates to form individual generally rectangularly shaped transducer array modules, the transducer elements of each of said transducer array modules having a center-to-center spacing that is relatively uniform throughout said array module, and outermost transducer elements of each of said transducer mounting plates being position along each of the perimeter edges of the transducer mounting plate such that a substantially uniform center-to-center spacing between transducer elements of the transducer array modules is substantially maintained across contiguous transducer array modules when the transducer array modules are fitted together by fitting together the mounting plates of the transducer array modules along their complimentary perimeter edges, wherein, when fitted together, transducer array modules form a larger transducer array that has a generally rectangular block form and that fills at least approximately 75% of a circle circumscribing said transducer array, and wherein the transducer elements of each transducer array module of said transducer array can be driven by a signal input such that each of the contiguous transducer array modules produces an acoustic output that combines with acoustic outputs of other transducer array modules to an produce an acoustic output from the transducer array in the form of a focused directional beam.

* * * * *

UNITED STATES PATENT AND TRADEMARK OFFICE

CERTIFICATE OF CORRECTION

PATENT NO. : 8,238,588 B2
APPLICATION NO. : 12/361517
DATED : August 7, 2012
INVENTOR(S) : John D. Meyer et al.

It is certified that error appears in the above-identified patent and that said Letters Patent is hereby corrected as shown below:

In column 1, line 35, “dishes” should read --dish’s--.
In column 2, line 27, “range the” should read --range of the--.
In column 2, line 56, “move loudspeaker” should read --move the loudspeaker--.
In column 4, line 17, “is layout” should read --is a layout--.
In column 4, line 30, “is graphical view” should read --is a graphical view--.
In column 4, line 34, “is graphical view” should read --is a graphical view--.
In column 7, line 50, “a” should be deleted before “corresponding”.
In column 8, line 26, “the” should read --than--.
In column 9, line 24, “turn, would suitably” should read --turn, suitably--.
In column 14, line 47, --be-- should be inserted after “shall”.
In column 15, line 5, “position” should read --positioned--.
In column 16, line 34, “position” should read --positioned--.

Signed and Sealed this
First Day of January, 2013

David J. Kappos

David J. Kappos
*Director of the United States Patent and Trademark Office*